US007370597B1

(12) United States Patent
Schwindaman

(10) Patent No.: US 7,370,597 B1
(45) Date of Patent: May 13, 2008

(54) RETRACTABLE FOLDING TOP ASSEMBLY

(76) Inventor: Michael A. Schwindaman, 24141 North St., Cassopolis, MI (US) 49031

( * ) Notice: Subject to any disclaimer, the term of this patent is extended or adjusted under 35 U.S.C. 154(b) by 0 days.

(21) Appl. No.: 11/697,653

(22) Filed: Apr. 6, 2007

(51) Int. Cl.
*B63B 17/00* (2006.01)
*E04H 15/00* (2006.01)

(52) U.S. Cl. ..... 114/361; 135/87

(58) Field of Classification Search ..... 114/361
See application file for complete search history.

(56) References Cited

U.S. PATENT DOCUMENTS 3,195,549 A 7/1965 Stevens
6,209,477 B1 4/2001 Biedenweg
6,637,815 B1 * 10/2003 Louque et al. ..... 297/184.11
6,666,163 B2 * 12/2003 Pastor et al. ..... 114/361
6,983,716 B1 1/2006 Ankney et al.
7,100,964 B2 * 9/2006 MacNee, III ..... 296/117

FOREIGN PATENT DOCUMENTS

JP 362031515 A 2/1987

* cited by examiner

*Primary Examiner*—Jesús D Sotelo
(74) *Attorney, Agent, or Firm*—Botkin & Hall, LLP

(57) ABSTRACT

A retractable top assembly for a vehicle, commonly referred to as a bimini top, includes a covering mounted on a pair of struts which are movable relative to one another to move the covering between a deployed position covering at least a portion of the vehicle and a retracted position. In the retracted position, the covering is wound upon a spindle rotatably mounted within a housing mounted on one of the struts. The housing has a slot through which the covering extends, so that the covering is attached to the other strut. A torsion spring within the housing biases the spindle in a direction winding the covering onto the spindle and thereby maintaining tautness of the covering as it unwinds from the spindle and is moved into the deployed position.

12 Claims, 2 Drawing Sheets

RETRACTABLE FOLDING TOP ASSEMBLY

BACKGROUND OF THE INVENTION

1. Field of the Invention

This invention relates to a retractable folding top assembly for vehicles.

2. Description of the Background of the Invention

Deck, pontoon, and similar type watercraft are often equipped with a retractable folding top assembly, commonly referred to as a bimini top. The folding top assembly includes struts that support a covering, typically of canvas, over some or all of the occupants when the folding top assembly is deployed in the fully deployed position to shade the occupants from the sun and to provide limited protection of the occupants during inclement weather. The folding top assembly may be folded and fully retracted against the front or rear of the watercraft on cool days when direct sun is desirable, but many users also deploy the folding top assembly in a so-called 'radar' position in which the folding top assembly is folded, but the struts are deployed in an intermediate, angled position, thus providing for direct sun but also permitting easy access to all of the seats of the watercraft. As disclosed in U.S. patent application Ser. Nos. 11/148,073 (now abandoned) and 11/192,383, the folding top assembly requires secondary struts to support the covering and requires a boot to enclose the covering when the folding top assembly is in the fully retracted or radar positions. The secondary struts, which are necessary to support the covering and insure that the covering does not sag when the folding top assembly is deployed, add cost and complexity to the assembly. The boot must also be installed when the folding top assembly is fully retracted and removed when the folding top assembly is deployed, and many users find it difficult to install and remove the boot.

SUMMARY OF THE INVENTION

The present invention relates to a retractable folding top assembly for a vehicle, commonly referred to as a bimini top, which includes a covering mounted on a pair of struts which are movable relative to one another to move the covering between a fully open position covering at least a portion of the vehicle to a fully retracted position. In the fully retracted position, the covering is contained within a reel assembly and is wound upon a spindle rotatably mounted within a housing mounted on one of the struts. The housing has a slot through which the covering extends, so that the covering is attached to the other strut. A torsion spring within the housing biases the spindle in a direction winding the covering onto the spindle and thereby maintaining tautness of the covering as it unwinds from the spindle and is moved into the deployed position.

DETAILED DESCRIPTION OF INVENTION

Figure 1:
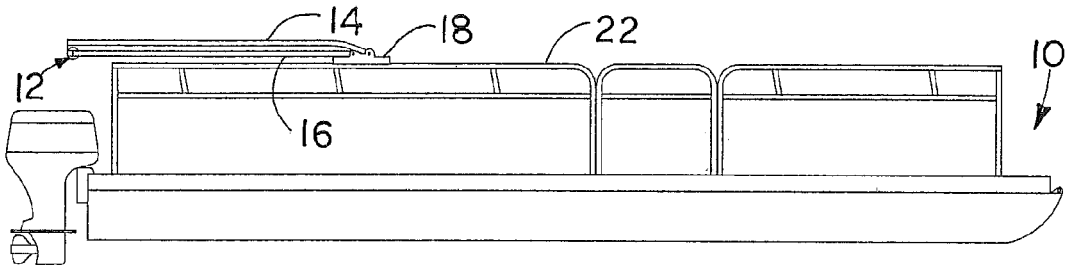
FIG. 1, FIG. 2 and FIG. 3 are each side elevation views of a typical watercraft having a retractably folding top assembly employing the present invention, the assembly being illustrated in the fully retracted, radar and fully open positions respectively.
Figure 2:
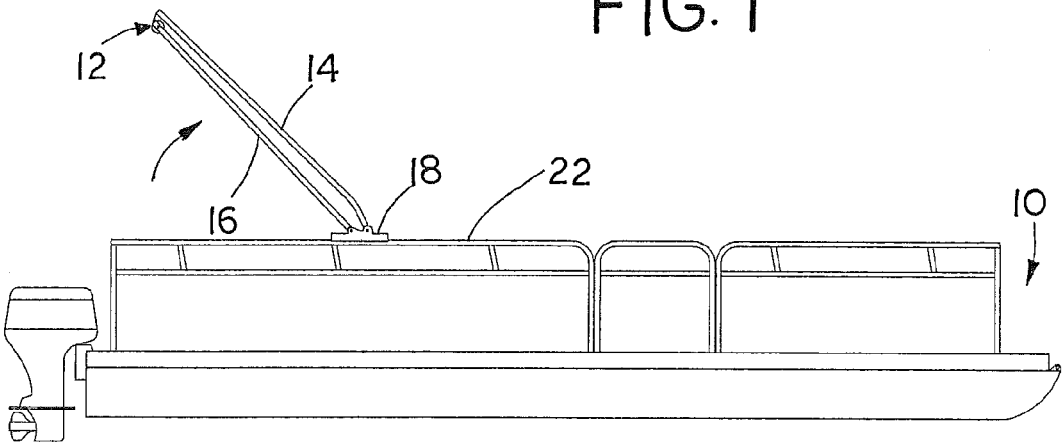
Figure 3:
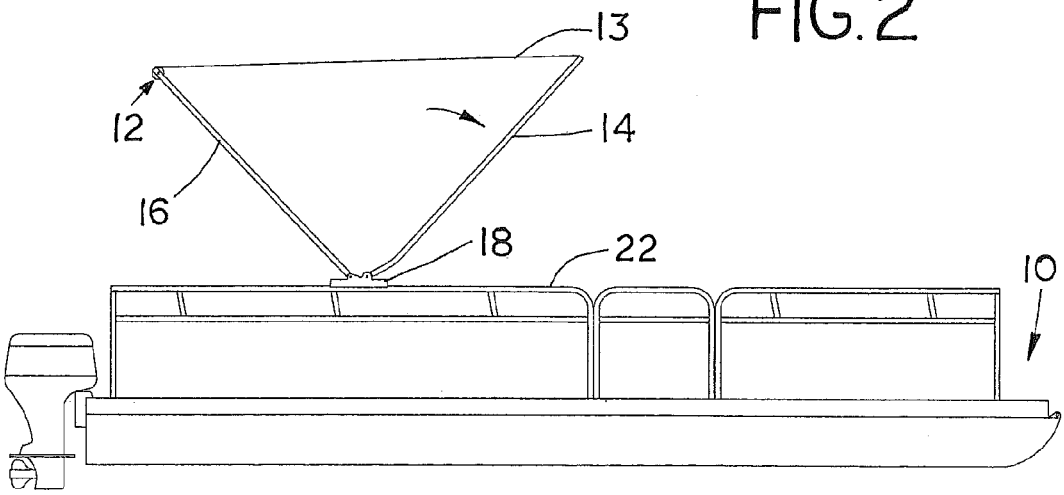

Referring now to FIGS. 1-3, a typical vehicle, such as a watercraft or pontoon boat employing the present invention, is illustrated at 10, including a retractable folding top assembly generally indicated by the numeral 12. The folding top assembly 12 includes a cover 13, which is supported by a pair of front and rear struts 14, 16, each of which is pivotally mounted on housings 18 which are mounted on opposite sides of the vehicle 10. The housings 18 include actuating mechanisms which move the folding top assembly 12 among the positions illustrated in FIGS. 1, 2, and 3. These mechanisms may be either commercially available manual actuating mechanisms, or power mechanisms disclosed in co-pending U.S. patent application Ser. No. 11/192,383. It will be noted that the struts 14, 16 are generally 'U'-shaped and bridge across the open deck of the vehicle 10, and that the housings 18 are each mounted on upper rail 22 on opposite sides of the vehicle 10 and are operated simultaneously to retract and deploy the folding top assembly 12.

The folding top assembly 12 is illustrated in the fully retracted position in FIG. 1. In this position, the folding top assembly 12 obstructs some of the seats at the rear of the vehicle. However, the folding top assembly 12 can be moved from the fully retracted position of FIG. 1 into an intermediate or radar position illustrated in FIG. 2. In this position, the folding top assembly 12 remains folded so that almost the entire deck of the vehicle is exposed, but the rear of the vehicle is not obstructed. The rear strut 16 remains locked in the position illustrated in FIG. 2 as the front strut 14 is pivoted away from rear strut 16 into the position illustrated in FIG. 3, in which the folding top assembly 12 is in the fully open position.

Figure 4:
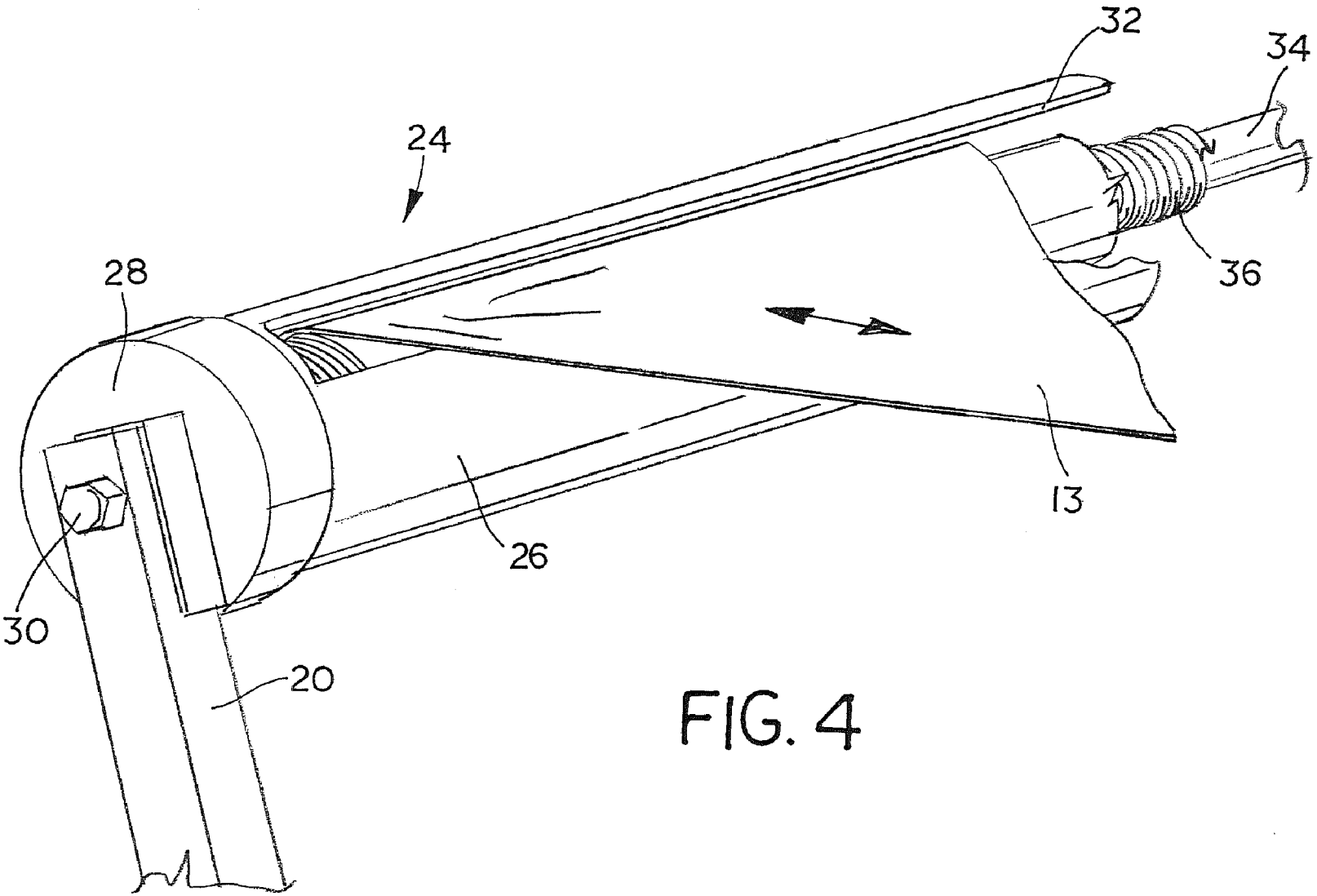
FIG. 4 is an enlarged, fragmentary view in perspective of a housing and spindle of the retractable folding top assembly illustrated in FIGS. 1-3.

The rear strut 16 includes a pair of upwardly extending arms, only one of which is shown at 20 (FIG. 4). One end of each of the arms 20 is pivotally mounted in the corresponding housing 18 which includes the actuator, as described above, and a transverse leg that extends across the vehicle 10 and connects the opposite upper ends of the arms 20. The transverse leg of the strut 16 is defined by a reel assembly, generally indicated by the numeral 24, from which the covering 13 extends and retracts and in which the covering is stored when the folding top assembly 12 is in the fully retracted or radar positions illustrated in FIGS. 1 and 2. The reel assembly 24 includes a non-rotatable, circumferentially extending outer housing 26 closed by a pair of end caps, only one of which is shown at 28, each of which is connected to its corresponding arm 20 by an appropriate fastener 30. A longitudinally extending slot 32 is defined in the housing 26 to provide an opening through which the covering 13 extends and retracts. The free end of the covering 13 (which extends from the slot 32) is attached to the transverse arm (not shown) of the front strut 14.

The reel assembly 24 further includes a spindle 34 which is rotatably supported within the housing 26 and is circumscribed thereby. A torsion coil spring 36 is wrapped around the spindle 34. One end of the spring 36 is secured to the spindle 34, and the opposite end of the spring 36 is secured to a non-rotating part of the reel assembly 24, such as the housing 26 or one of the end caps 28. The covering 13 is wound around the torsion spring 36 and the spindle 34. The torsion spring is wound such that it exerts a relatively small torque on the spindle 34 when the covering 13 is fully retracted within the housing 26, the torque biasing the spindle 34 to rotate in the counterclockwise direction, thus rotating the spindle 34 in a direction retracting the covering 13 into the housing 26. As the front strut 14 is moved away from the rear strut 16 to move the covering 13 from the fully retracted position illustrated in FIG. 1 and into the fully open position illustrated in FIG. 3, the covering is pulled out of the housing 26, and the spindle 34 is rotated in the clockwise direction, thus winding the spring 36 to increase the biasing torque opposing rotation of the spindle 34 in the clockwise direction. When the strut 14 is moved toward the strut 16, the bias of the spring 36 winds the covering on the spindle 34. The reel assembly 24 is similar to the mechanism used in prior art retractable awnings.

Since the spring 36 is wound as the covering is deployed, the force urging the covering 13 back into the housing is increased, maintaining the covering taut in the fully open position illustrated in FIG. 3, thus obviating the need of the secondary struts needed in the prior art to support the covering. Accordingly, the complexity of the secondary struts is eliminated in the present invention. Furthermore, when the covering 13 is retracted into the housing 26, the covering 13 is protected from the environment, the boot necessary in prior art folding top assemblies to enclose the folded folding top assembly is eliminated. The boot must be installed and removed manually, and since such installation and removal is time-consuming, many users often fail to install the boot. Since the boot is a separate component, the boot is easily misplaced when it is removed. Accordingly, the present invention provides secure storage of the covering 13 without requiring separate action by the user.

What is claimed is:

1. Retractable folding top assembly for a vehicle, comprising:

a pair of main struts pivotally mounted for pivotal movement relative to one another and relative to the vehicle, said struts being movable toward and away from one another;

a covering supported by said struts;

a reel mounted on one of said struts for storing said covering, the other strut being attached to said covering whereby movement of said other strut away from said one strut deploys the covering to a deployed position covering at least a portion of the vehicle, said covering being retracted into said reel as the other strut is moved toward the one strut until the covering is in a retracted position; and an actuator for moving said struts relative to one another.

2. Retractable folding top assembly as claimed in claim 1, wherein said reel includes a spindle rotatable relative to said one strut, said covering being wound unto said spindle as the covering is retracted into said reel and being unwound from said spindle as the covering is moved toward the deployed position.

3. Retractable folding top assembly as claimed in claim 1, wherein a spring provides a biasing force retracting said covering when the other strut is moved toward the one strut.

4. Retractable folding top assembly as claimed in claim 2, wherein said reel includes a torsion spring, said torsion spring being wound by movement of the covering off of said spindle as the covering is moved toward the deployed position to provide a biasing force maintaining tautness of the covering as the covering is deployed and rotating said spindle in a direction winding the covering thereupon as the covering is returned from the deployed position.

5. Retractable folding top assembly as claimed in claim 4, wherein said torsion spring is wound upon said spindle.

6. Retractable top assembly as claimed in claim 4, wherein said reel includes a housing mounted on said one strut, said spindle being rotatably mounted within said housing, said housing defining a slot through which said covering extends.

7. Retractable top assembly as claimed in claim 1, wherein said reel includes a housing mounted on said one strut, said spindle being rotatably mounted within said housing, said housing defining a slot through which said covering extends.

8. Retractable top assembly for a vehicle, comprising:

a pair of main struts pivotally mounted for pivotal movement relative to one another and relative to the vehicle, said struts being movable toward and away from one another;

a covering supported by said struts;

a housing mounted on one of said struts for storing said covering, the other strut being attached to said covering whereby movement of said other strut away from said one strut deploys the covering to a deployed position covering at least a portion of the vehicle, said housing including a slot, said covering extending through said slot and being retracted into said housing as the other strut is moved toward the one strut until the covering is in a retracted position; and an actuator for moving said struts relative to one another.

9. Retractable folding top assembly as claimed in claim 8, wherein a spring mounted within said housing provides a biasing force retracting said covering when the other strut is moved toward the one strut.

10. Retractable top assembly as claimed in claim 9, wherein a torsion spring is mounted within said housing, said torsion spring being wound by movement of the covering toward the deployed position to provide a biasing force maintaining tautness of the covering as the covering is deployed and biasing the covering into the housing as the covering is returned from the deployed position.

11. Retractable folding top assembly as claimed in claim 9, wherein a spindle is rotatably mounted within said housing, said covering being wound unto said spindle when the covering is retracted into said housing and being unwound from the housing as the covering is deployed into said deployed position.

12. Retractable folding top assembly as claimed in claim 11, wherein said spring is mounted within said housing and biases said spindle in a direction winding said covering onto said spindle.

* * * * *